US006513598B2

(12) United States Patent
Moore et al.

(10) Patent No.: US 6,513,598 B2
(45) Date of Patent: Feb. 4, 2003

(54) DRILLABLE FLOATING EQUIPMENT AND METHOD OF ELIMINATING BIT TRIPS BY USING DRILLABLE MATERIALS FOR THE CONSTRUCTION OF SHOE TRACKS

(75) Inventors: Seth R. Moore, Conroe, TX (US); Henry E. Rogers, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/811,918

(22) Filed: Mar. 19, 2001

(65) Prior Publication Data

US 2002/0129944 A1 Sep. 19, 2002

(51) Int. Cl.[7] ..... E21B 21/10; E21B 10/32
(52) U.S. Cl. ..... 166/376; 166/317; 175/257
(58) Field of Search ..... 166/373, 376, 166/117.6, 317; 175/91, 258, 262, 266, 257

(56) References Cited

U.S. PATENT DOCUMENTS

| | | | | |
|---|---|---|---|---|
| 3,776,250 A | * | 12/1973 | Knox | 137/71 |
| 4,042,014 A | * | 8/1977 | Scott | 166/367 |
| 4,067,358 A | | 1/1978 | Streich | 137/624.13 |
| 4,171,019 A | * | 10/1979 | Cole | 166/341 |
| 4,190,112 A | * | 2/1980 | Davis | 166/291 |
| 4,413,682 A | * | 11/1983 | Callihan et al. | 166/382 |
| 4,712,619 A | | 12/1987 | Stepp et al. | 166/327 |
| 4,834,184 A | | 5/1989 | Streich et al. | 166/376 |
| 5,472,053 A | | 12/1995 | Sullaway et al. | 166/327 |
| 5,647,434 A | | 7/1997 | Sullaway et al. | 166/242.8 |
| 5,722,491 A | | 3/1998 | Sullaway et al. | 166/291 |
| 6,070,667 A | * | 6/2000 | Gano | 166/313 |
| 6,082,451 A | | 7/2000 | Giroux et al. | 166/72 |

FOREIGN PATENT DOCUMENTS

GB 2 351 513 A 1/2001

OTHER PUBLICATIONS

Halliburton Casing Equipment Brochure entitled "Advantage™ IPV Insert Poppet Valve" dated 11/97.
Halliburton Casing Equipment Brochure entitled "Super Seal™ II Floating Equipment" dated 11/97.
Halliburton Casing Sales Manual, Oct. 8, 1993, pp. 1–13 and 1–23.

* cited by examiner

*Primary Examiner*—Frank S. Tsay
(74) *Attorney, Agent, or Firm*—Craig W. Roddy; Anthony L. Rahhal

(57) ABSTRACT

A one trip method for drilling a wellbore below a cemented casing is disclosed. An apparatus for use in performing the method is also disclosed. The method comprises lowering a drill bit into a casing cemented in the wellbore. The casing has float equipment connected therein. The drill bit is rotated in the casing above the float equipment so that it expands radially outwardly to a diameter greater than the inner diameter of the casing.

The float equipment, which can be a float shoe or a float collar or any other type of float equipment known in the art, includes an outer case with a valve connected therein. The outer case is comprised of a drillable material. Thus, the drill bit utilized to drill the wellbore can begin its drilling operation above the float equipment and successfully drill a wellbore below the casing having a diameter greater than the inner diameter of the casing.

19 Claims, 7 Drawing Sheets

DRILLABLE FLOATING EQUIPMENT AND METHOD OF ELIMINATING BIT TRIPS BY USING DRILLABLE MATERIALS FOR THE CONSTRUCTION OF SHOE TRACKS

BACKGROUND OF THE INVENTION

This invention relates to floating equipment used in cementing operations, and to methods of drilling out float equipment to create a wellbore below a cemented casing, wherein the wellbore below the casing has a diameter larger than the inner diameter of the cemented casing.

Typically, after a well for the production of oil and/or gas has been drilled, casing will be lowered into the well and cemented in the well. Generally, casings of decreasing diameter will be used as the depth of the wellbore increases. In other words, a large diameter casing may be cemented in the uppermost portion of the wellbore, and a liner, which is simply a smaller diameter casing will extend from the lower end of the casing in the uppermost well portion. Additional liners of decreasing diameter can be cemented in the well until the desired depth is reached.

When casing is lowered into a well floating equipment, such as float shoes and float collars may be used in the casing. Typical of the float equipment that might be used is the Halliburton Super Seal II Float Collar and the Halliburton Super Seal II Float Shoe as shown in the Oct. 8, 1993, Halliburton Casing Sales Manual, pages 1–13 and 1–23, respectively. Other examples of float equipment are shown in U.S. Pat. No. 5,647,434 to Sullaway et al. and U.S. Pat. No. 5,472,035 to Sullaway et al., both of which are incorporated by reference. All of the float equipment disclosed therein has a valve affixed to an outer case, which is connected to the casing.

There are times when it is desirable to create a wellbore below the cemented casing that has a diameter greater than the inner diameter of the cemented casing. For example, there are times when it is necessary to set a liner having an outer diameter such that the wellbore in which the liner must be set is larger than the inner diameter of the casing thereabove.

When such a liner is to be placed in the well, the valve portion of the float equipment attached to the casing must be drilled out. The current practice of drilling out float equipment in the cemented casing is with a standard drill bit that has a diameter slightly less than the inner diameter of the casing string and of the outer case or outer housing of the float equipment which is attached to and forms a part of the casing. The same drill bit is sometimes used to drill ahead or past the bottom end of the float shoe to a depth that would enable another string of casing (i.e., the liner) to be run and cemented in place. If the wellbore below the casing is required to be greater than the inner diameter of the previous cemented casing, a process called underreaming is generally used. Underreaming is a process wherein the wellbore is drilled to the desired depth with the standard drill bit utilized to drill through the float equipment. That bit is removed and a special underreaming drill bit is lowered through the casing. Once the underreaming drill bit passes below the end of the casing and into the open end cased wellbore, the hole is underreamed. Thus, typically two trips are required to perform underreaming operations, one to drill through the cement plugs and float equipment and cemented casing string, as well as any open hole required to be drilled, and another special underreaming bit for underreaming operations.

Bi-center drill bits may also be used to drill the wellbore below the already cemented casing. Bi-center bits can thus be run through a specific inner diameter, for example the casing drift inner diameter, and can be rotated after passing through the casing to drill a wellbore having a diameter greater than the casing inner diameter. Bi-center drill bits have a non-working or non-rotating diameter, and have a larger working or rotating diameter. Using a bi-center bit is advantageous over underreaming since it is not required that the entire length of the wellbore be drilled with the drill bit that is utilized to drill out the float equipment. Instead, the float equipment can be drilled out to slightly below the end of the casing with a standard drill bit which can then removed from the well. The bi-center drill bit can then be utilized and can begin drilling below the bottom end of the float equipment which is part of the previously cemented casing string. While use of a bi-center bit saves some time, it still requires two trips into the well which is time consuming and costly. Thus, there is a need for a method and apparatus which will provide for one trip drilling of a wellbore below a cemented casing, wherein the wellbore below the cemented casing has a diameter larger than the inner diameter of the already cemented casing string.

SUMMARY OF THE INVENTION

The present invention solves the foregoing by providing a method and apparatus for creating a wellbore having a diameter larger than the inner diameter of a previously cemented casing in one trip.

The method comprises lowering a drill bit through cemented casing. The drill bit has a non-working or non-rotating diameter that is smaller than the inner diameter of the previously cemented casing. The casing, as is well known in the art, will typically have float equipment connected therein. The float equipment can comprise a float shoe, and/or a float collar or any other type of float equipment known in the art. The drill bit, which preferably will comprise a bi-center drill bit, will be lowered into the casing to the point at which it is desired to begin drilling of the wellbore. The drill bit is then rotated at a selected speed which will cause the drill bit to move from its non-working or non-operating position to a working or rotating position in which the drill bit will drill a hole or wellbore having a diameter greater than the inner diameter of the previously cemented casing. The drill bit is rotated in the casing at a point above the float equipment and is lowered so that it will drill out any casing therebelow along with the float equipment. The drill bit is continually lowered in its working rotating position until the desired depth of the wellbore is reached. Rotation of the drill bit may then be stopped and the drill bit withdrawn from the well through the previously cemented casing.

The floating equipment utilized with the casing comprises an outer case having a valve disposed therein. The valve is preferably connected to the outer case with a cement body portion. The outer case of the floating equipment is adapted to be connected in the casing string and preferably has threads so that it can be threaded in the casing string. The outer case is comprised of a drillable material so that the drill bit utilized to drill the wellbore below the cemented casing can drill through the float equipment including the valve, body portion and the outer case. Any tubulars or joints used between float collars and/or a float collar and the float shoe are also comprised of a drillable material.

BRIEF DESCRIPTION OF THE DRAWINGS

FIGS. 2C and 2D show the wellbore drilled to a desired depth and show a running pipe disclosed therein.

DETAILED DESCRIPTION OF THE PREFERRED EMBODIMENT

Figure 1A:
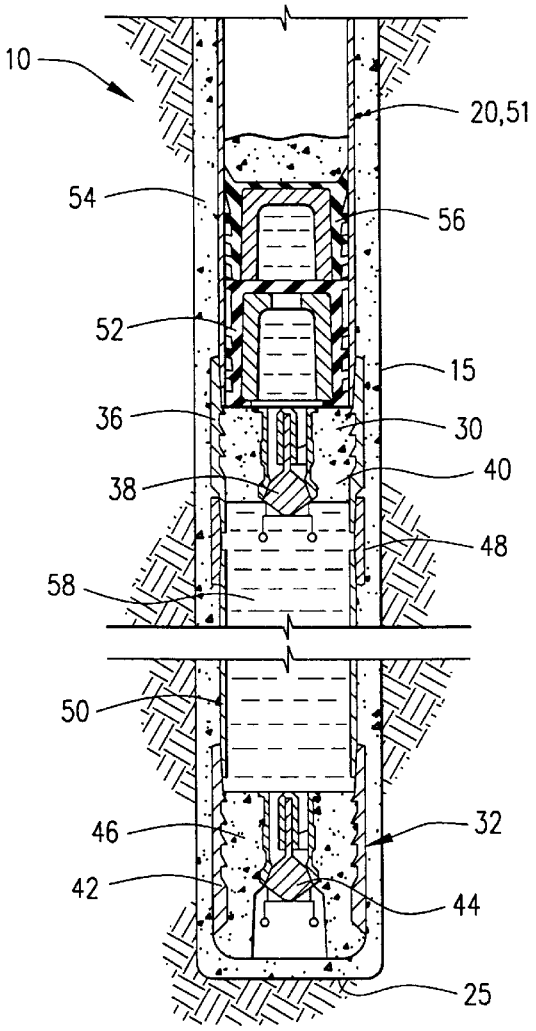
FIG. 1A shows a cross-sectional view of a well having a casing cemented therein.

Referring now to the drawings and more particularly to FIGS. 1A–1D, a prior art method of underreaming a well is shown and described. FIG. 1A schematically depicts a well 10 comprising a wellbore 15 having a casing string 20 cemented therein. Well 10 has a bottom 25. As shown in FIG. 1A, a float collar 30 and float shoe 32 are disposed and cemented in wellbore 15. As known in the art, float collar 30 comprises an outer case or outer housing 36 having a valve 38 connected thereto with a cement body portion 40. Float shoe 32 likewise comprises an outer case or outer housing 42 having a valve 44 connected thereto with a cement body portion 46. Outer case 36 has a steel coupling 48 attached thereto which is in turn connected to a lower steel casing 50. Lower steel casing 50 is connected to outer case 42 of float shoe 32. The portion of casing string 20 above float collar 30 may be referred to as an upper casing 51. Thus, casing string 20 comprises upper casing 51, outer case 36 of float collar 30, coupling 48, lower casing 50 and outer case 42 of float shoe 32. In the prior art, all the elements of casing string 20 are comprised of steel. The procedure for cementing the casing 20 in the wellbore, which is well known, is as follows.

A first or bottom cement or wiper plug 52 is pumped ahead of the cement slurry to be used to cement casing string 20 in the wellbore. The cementing plug will sealingly engage the inner surface of casing string 20 and will separate the drilling fluid ahead of the bottom cement plug 52 and the cement slurry behind cement plug 52. Bottom cement plug 52 has a rupturable member across the top thereof. Once bottom plug 52 lands on float collar 30, continued displacement of cement behind bottom plug 52 will cause the rupturable member to rupture allowing flow through bottom plug 52, float collar 30, float shoe 32 and into an annulus 54 between casing string 20 and wellbore 15. When the required volume of cement slurry has been pumped through the casing, a second or top cementing plug 56 is released into the pipe to separate the cement slurry from additional drilling fluid or other fluid used to displace the cement slurry down the pipe. Upper cement plug 56, also referred to as wiper plug 56 will sealingly engage and wipe the walls of casing 20. As shown in FIG. 1, it is necessary to displace enough cement into the well so that good cement as opposed to contaminated cement extends from the bottom 25 of the well upwardly in the annulus. The contaminated cement which may exist due to the upper plug wiping the walls of the casing will be present above the float shoe and below the float collar in what is commonly referred to as the shoe track 58. The shoe track thus has a shoe track volume which is simply the volume of the space between the float collar and the float shoe. It is apparent from the schematic that some contaminated cement may also be located above float collar 30.

Figure 1B:
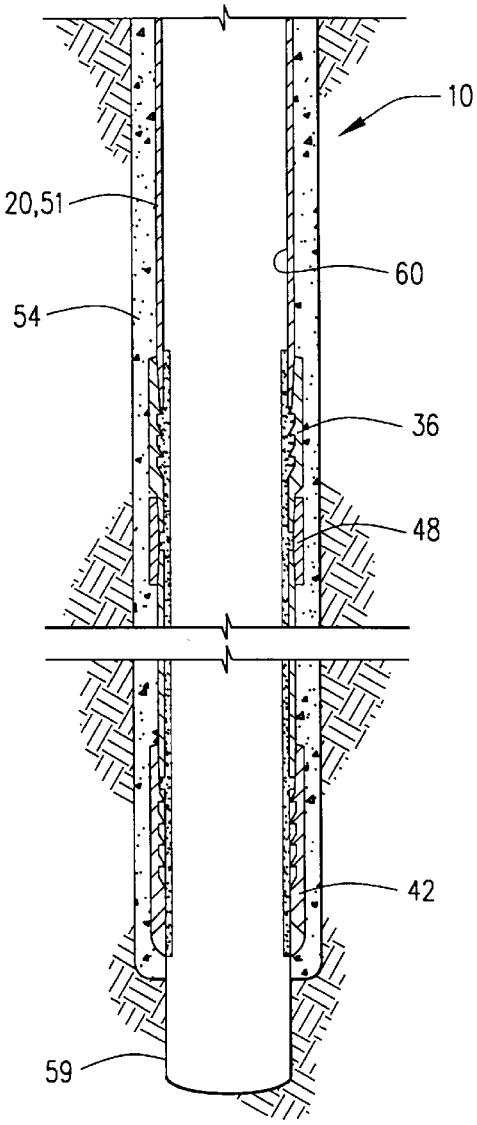
FIG. 1B shows the wellbore of FIG. 1A after the internal portions of the float equipment have been drilled out.
Figure 1C:
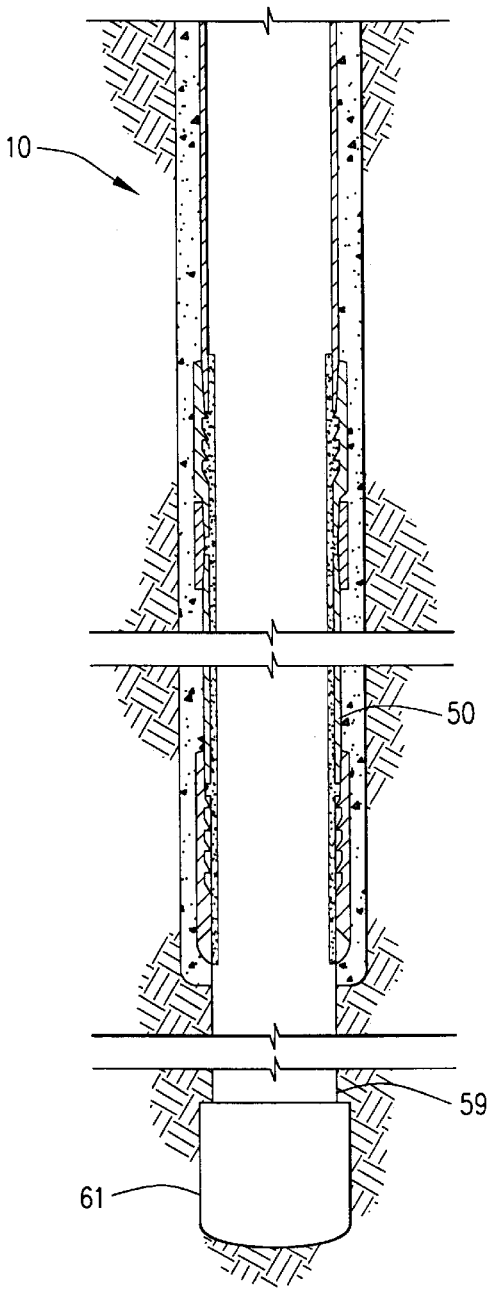
FIGS. 1C and 1D schematically show the well after a portion of the well below the cemented casing has been underreamed and a smaller casing, or liner has been lowered therein.
Figure 1D:
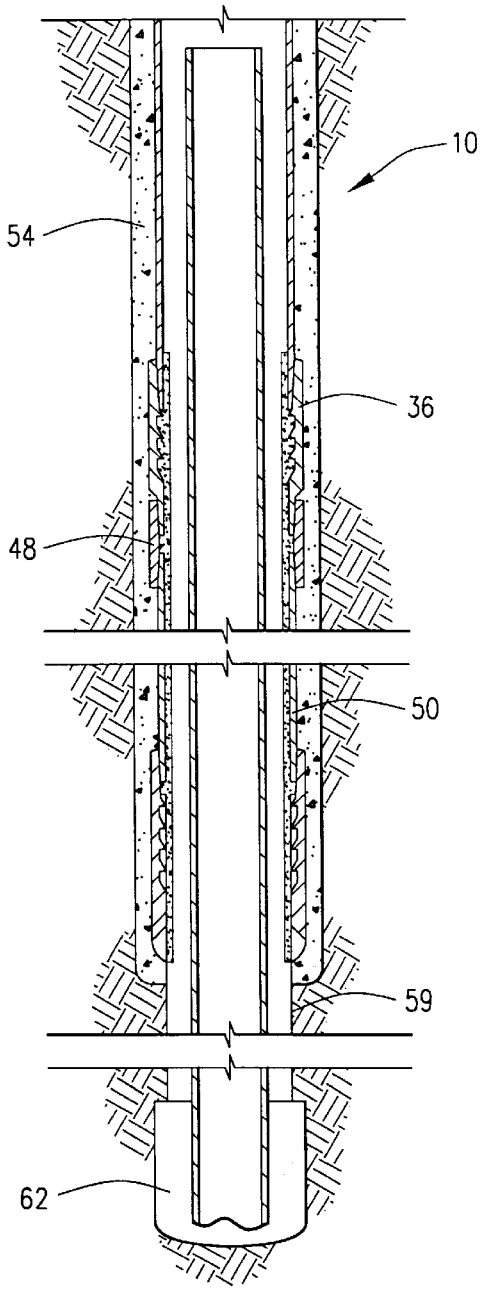

Once the cement job is complete, a drill bit can be lowered into the casing string and the well 10 can be drilled deeper as depicted in FIG. 1B. The portion of the well 10 below original bottom 25 may be referred to as lower wellbore, or wellbore extension 59. Wellbore extension 59 is created by lowering a drill bit through casing 20, wherein the drill bit has an inner diameter less than an inner diameter 60 of casing 20. The diameter of the drill bit utilized must be smaller than the innermost diameter of casing 20 which may be defined on any of casing portions 51, 36, 48, and 42, and herein is shown as inner diameter 60. If it is necessary and desirable to create a wellbore extension having a diameter greater than innermost diameter 60, an additional trip into the wellbore is required to create underreamed section 61 of wellbore extension 58. Underreaming is a procedure that is well known in the art. FIG. 1D shows a casing being lowered into well 10 so it will extend downwardly into underreamed section 61 defining an annulus 62 large enough so that a proper cementing job can be performed. Section 61 can be created by utilizing a bi-center bit which can be lowered through well 10 after the valve portion of the float equipment has been drilled out, as depicted in FIG. 1B. The bi-center bit can be rotated after it passes below bottom 25.

Figure 2A:
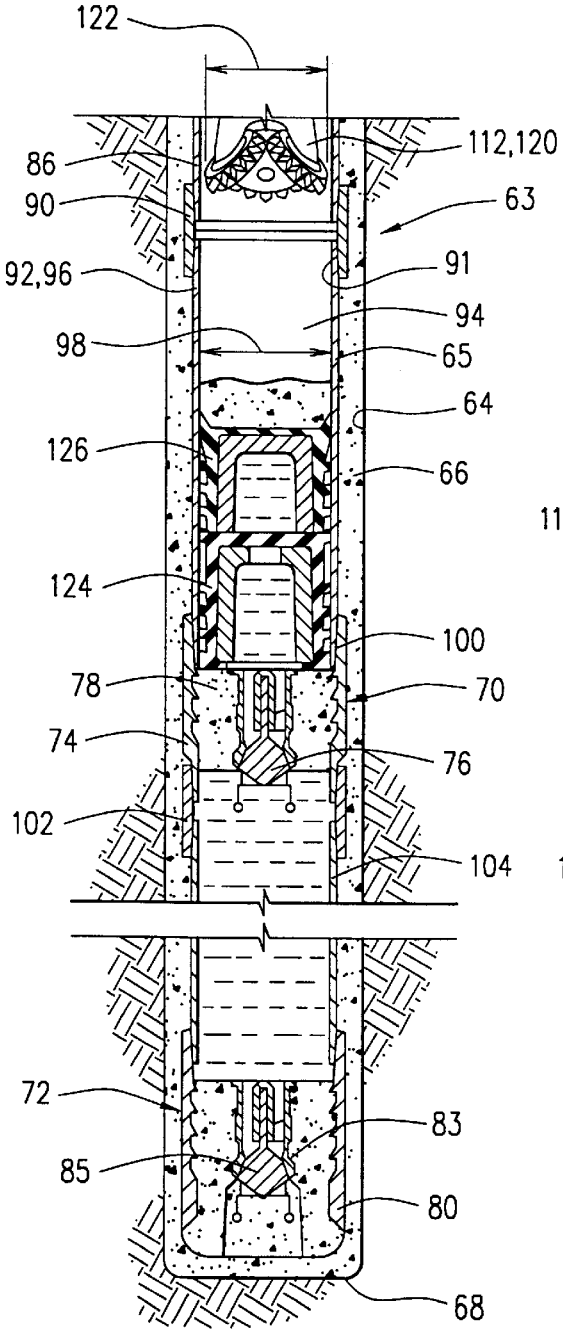
FIG. 2A is a cross-section of a well having casing cemented therein and having float equipment of the present invention attached thereto.

FIGS. 2A–2D show the method of the present invention of creating the lower wellbore or wellbore extension having a diameter greater than the inner diameter of a casing string already cemented in a wellbore. FIG. 2A shows a well 63 comprising a wellbore 64 having a casing 65 cemented therein. Annulus 66 is defined by wellbore 64 and casing 65. Wellbore 64 has a bottom 68. Casing 65 has float equipment, namely a float collar 70 and a float shoe 72, connected therein. Float collar 70 comprises an outer case 74 having a check valve 76 connected therein with a body portion which is preferably a cement body portion 78. Valve 76 can be of any of the type known in the art, as for example the valve included in the Halliburton Super Seal II Float Collar or one of those shown in U.S. Pat. Nos. 5,647,434 or 5,472,035, the details of which have been incorporated herein by reference.

Prior art float collars are made with steel outer cases. Outer case 74 is not comprised of steel, but rather is to be comprised of a drillable material such as, but not limited to aluminum or nonmetallic materials including engineering grade plastics, resins, composites or other suitably known materials. Float shoe 72 comprises an outer case 80 having a valve 82 connected thereto with a body portion which is preferably a cement body portion 84. Valve 82 is well known in the art and may be like that utilized in the Halliburton Super Seal II Float Shoe or like that shown in the above-referenced U.S. Patents. Valve 82, as is known in the art, may comprise a valve housing 83 having a valve element 85 disposed therein, along with other components, all of which are comprised of a drillable material such as, but not limited to phenolic plastic. The valve element and valve housing of float collar 70 are likewise comprised of drillable materials.

Outer case 80 of float shoe 72, instead of being comprised of steel as is known in the prior art, is made from a drillable material which may include, but which is not limited to aluminum or nonmetallic materials including engineering grade plastics, resins, composites, or other suitable known materials.

Casing string 65 may comprise an upper casing or upper casing portion 86 having an inner diameter 88 and a lower end 89. Upper casing 86 is comprised of steel. Upper casing 86 has a coupling 90 connected thereto, preferably threadably connected thereto at lower end 89. Coupling 90 is attached to a lower casing or lower casing portion 92 at the upper end 91 thereof. Lower casing 92 defines a longitudinal central opening 94. Lower casing 92 comprises a first, or upper, drillable shoe tubular 96 connected to coupling 90. Drillable shoe tubular is preferably comprised of one of the drillable materials set forth herein. Drillable shoe tubular 96 defines an inner diameter 98 and has a lower end 100. Drillable shoe tubular 96 is connected at its lower end thereof to outer case 74 of float collar 70. Outer case 74 is in turn connected to a coupling 102. Coupling 102 is connected to a second or lower drillable shoe tubular 104. Coupling 102 and drillable shoe tubular 104 are preferably comprised of one of the drillable materials set forth herein. Lower shoe tubular 104 may be referred to as a shoe track and the volume between float collar 70 and a float shoe may be referred to as a shoe track volume. Second or lower shoe tubular 104 has an upper end 106, a lower end 108 and defines an inner diameter 110. Lower shoe tubular 104 is connected at its lower end 108 to outer case 80 of float shoe 72.

Figure 2B:
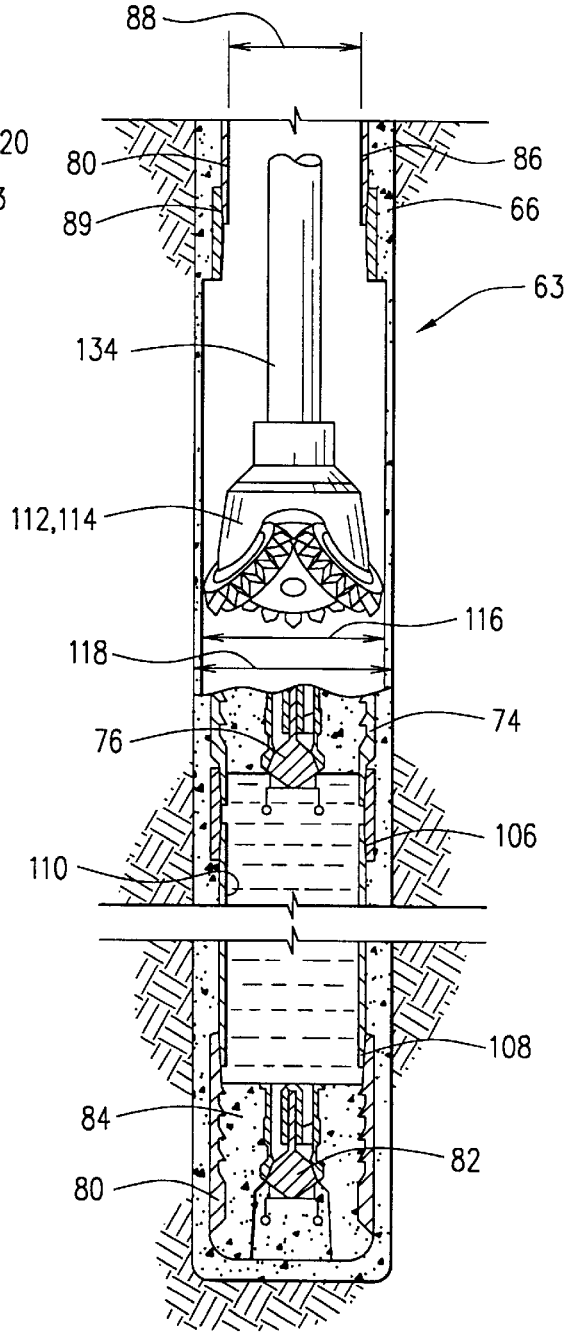
FIG. 2B schematically shows a drill bit drilling a wellbore having a diameter greater than the inner diameter of the casing cemented thereabove.
Figure 20:
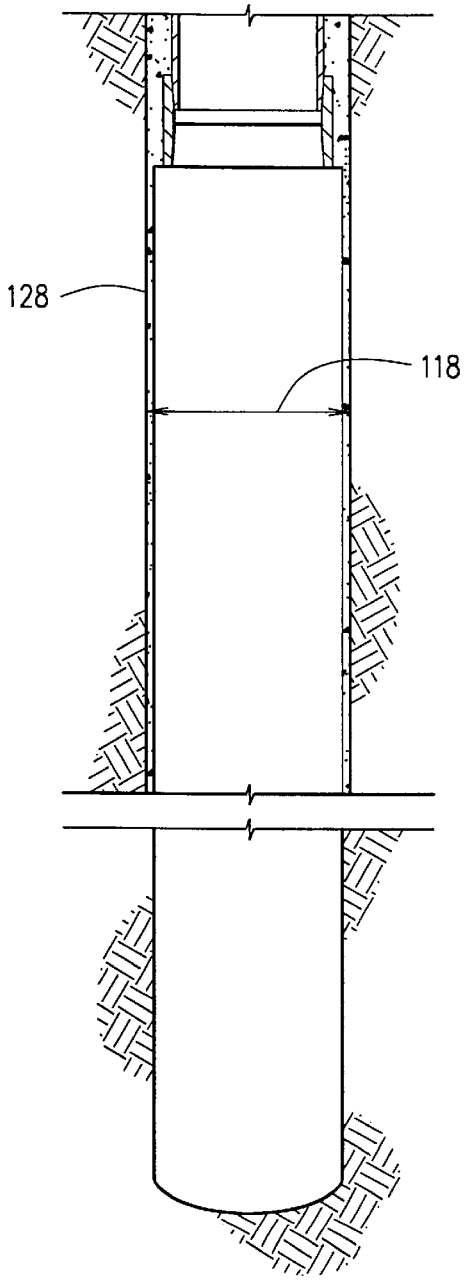
Figure 20:
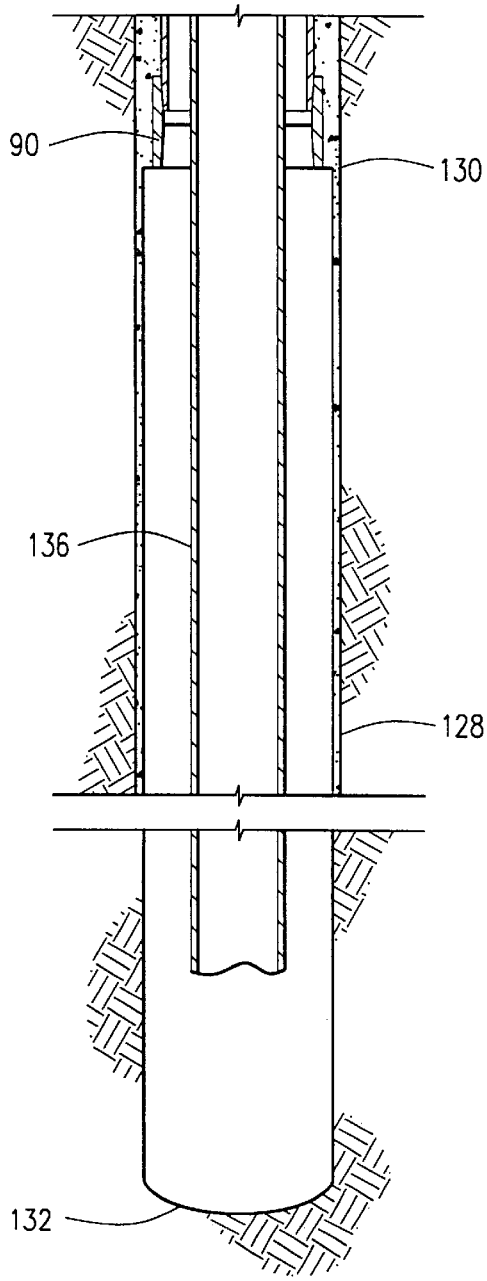

FIG. 2B schematically shows a drill bit 112, preferably a bi-center drill bit in its rotating or operating position 114. In rotating position 114, drill bit 112 has a diameter 116 which will drill a hole having a bore with a diameter 118. Drill bit 112 is shown in FIG. 2A in non-rotating or non-operating position 120. As is apparent, the representation of drill bit 112 is a schematic and is preferably a bi-center drill bit, which is known in the art. In non-operating position 120, drill bit 112 has a diameter 122 that is smaller than the innermost diameter of casing string 65. In the embodiment shown, inner diameters 88, 98 and 110 are substantially the same and comprise the innermost diameter. Rotation of drill bit 112 at a pre-selected speed will cause drill bit 112 to move from its non-operating or non-rotating position 120 to its rotating position 114.

Casing 65 is cemented in wellbore 64 in normal fashion utilizing bottom and top cement plugs 124 and 126, respectively. Because, as will be explained in more detail hereinbelow, the casing can be drilled out from a point above the cement plugs, it is not necessary that fully competent cement be placed around the float shoe, or the float collar since that portion of the casing will be drilled out. Thus, if desired, the length of the shoe track can be shortened and the need for competent cement in the annulus below the float collar can be eliminated since that cement will be drilled out.

Referring now to FIG. 2C, well 63 is shown including wellbore extension 128 having a diameter 118. Diameter 118 is greater than inner diameter 88 of upper casing 86. Wellbore extension 128 has an upper end 130 and a lower end 132. As shown in FIGS. 2A and 2B, bi-center drill bit 112 is lowered into the well through casing 65 in its non-operating position 120. Once drill bit 112 reaches the desired depth in the well, drill pipe 134 may be rotated so that drill bit 112 will be moved from a non-operable position 120 to operable or rotating position 114 such that it will drill a wellbore having diameter 118.

Wellbore extension 128, which may also be referred to as lower wellbore 128, can be drilled starting at a point above float collar 70 since all of the materials from coupling 90 downwardly, including the outer cases 74 and 80 of float collar 70 and float shoe 72, respectively, drillable shoe tubular 96, coupling 102 and lower shoe tubular 104 are comprised of the drillable materials defined herein. Thus, it is not necessary to first make a bit trip to drill through cement plugs 124 and 126 and the interiors of the float collar and float shoes 70 and 72, respectively, with a drill bit having a diameter smaller than the inner diameter of the casing and then to remove that drill bit and underream or use a bi-center drill bit below the lower end of the float shoe. Only one trip is required with bi-center drill bit 112 since the drill bit will expand to a diameter greater than that of the inner diameter of the casing, and since the bi-center drill bit is capable of drilling through the drillable materials that exist in the well below coupling 90. Lower wellbore 128 can be drilled to any desired depth and has a lower end 132. Once lower wellbore 128 reaches its desired depth, the bit 112 can be withdrawn to the surface, in its non-rotating position 120, through the portion of casing 65 cemented in well 63 above lower wellbore 128. Pipe 136 can be lowered into lower wellbore 128 and cemented therein in any manner known in the art. Thus, the invention provides a method and apparatus for drilling a wellbore extension in one trip wherein the wellbore extension or lower wellbore has a diameter greater than the inner diameter of the casing cemented in the wellbore above the wellbore extension.

Figure 3A:
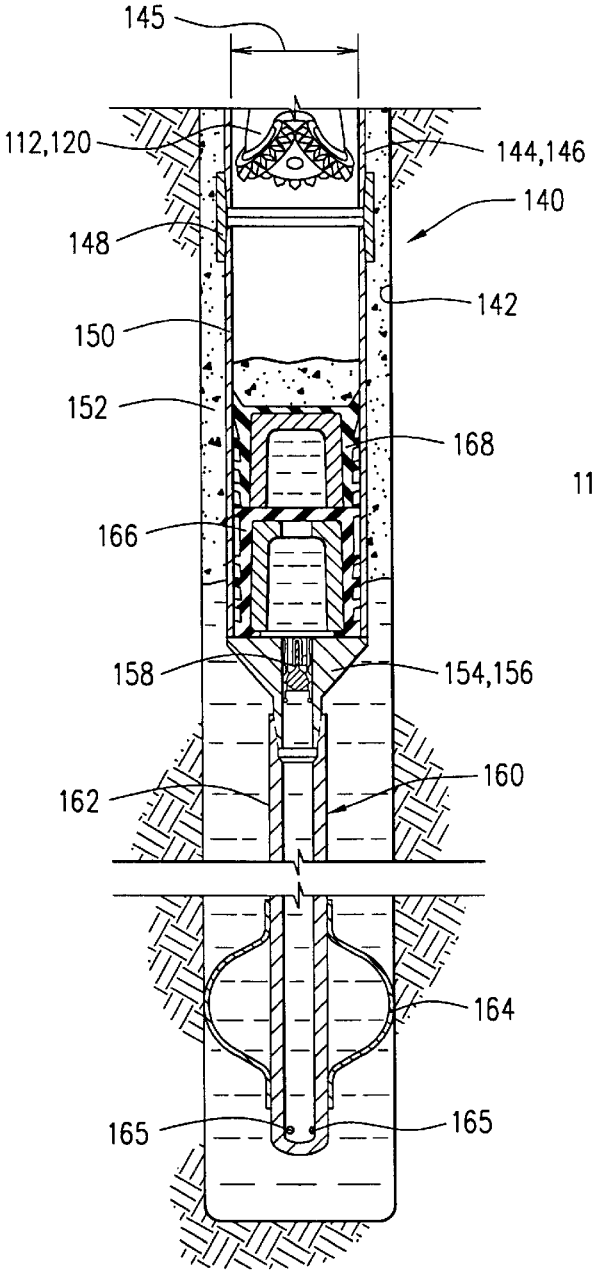
FIG. 3A shows a section of a well having casing cemented therein along with an additional embodiment of the float equipment of the present invention.
Figure 3B:
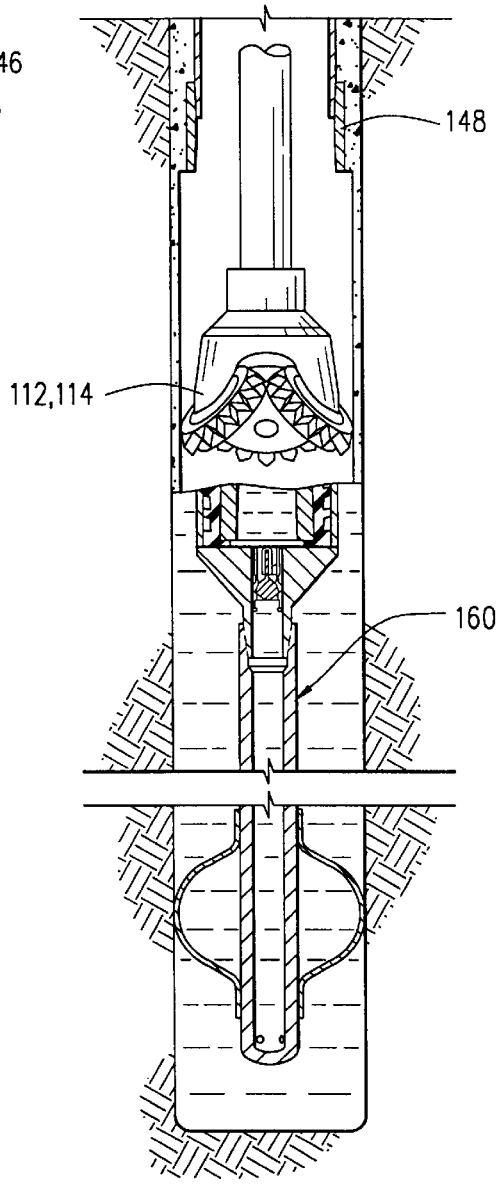
FIG. 3B schematically shows a bi-center drill bit drilling a wellbore having a diameter greater than the inner diameter of the casing thereabove.

FIGS. 3A–3D show a different embodiment of a casing string, wherein the manner in which the wellbore extension is drilled is like that described with the embodiment known in FIGS. 2A and 2D. FIG. 3A shows a well 140. Well 140 comprises a wellbore 142 having a casing 144 cemented therein. Casing 144 has an inner diameter 145 and may comprise an upper casing 146 having a coupling 148 connected to a lower end thereof. Coupling 148 is in turn connected to a lower casing 150. Casing 144 and wellbore 142 define an annulus 152 therebetween. Lower casing, or drillable shoe tubular 150 may be comprised of one of the drillable materials set forth herein and is connected at a lower end to a float valve 154. Float valve 154 comprises an outer case 156 connected to lower casing 150 and a valve 158 disposed therein. Outer case 156 is comprised of a drillable material. Float valve 154 is connected to a diverter tool 160 of a type known in the art. Schematically depicted, diverter tool 160 includes a diverter stem 162 having drag springs 164 connected thereto which will centralize casing 144 in the well. Stem 162 and drag spring 164 are comprised of drillable materials. Drill stem 162 has ports 165 therethrough so that cement can be displaced through casing 144 and drill stem 162 into the wellbore and thus into the annulus 152 to cement casing 144 in the wellbore. Casing 144 can be cemented in a manner known in the art such as for example using bottom and top cement plugs 166 and 168, respectfully. Once casing 144 has been cemented in the well, bi-center drill bit 112 can be lowered through the casing in its non-operating position 120. Once the desired location in the well is reached, bi-center drill bit 112 can be rotated so that it reaches its operating position 114 and can begin drilling wellbore extension or lower wellbore 170.

Figure 3C:
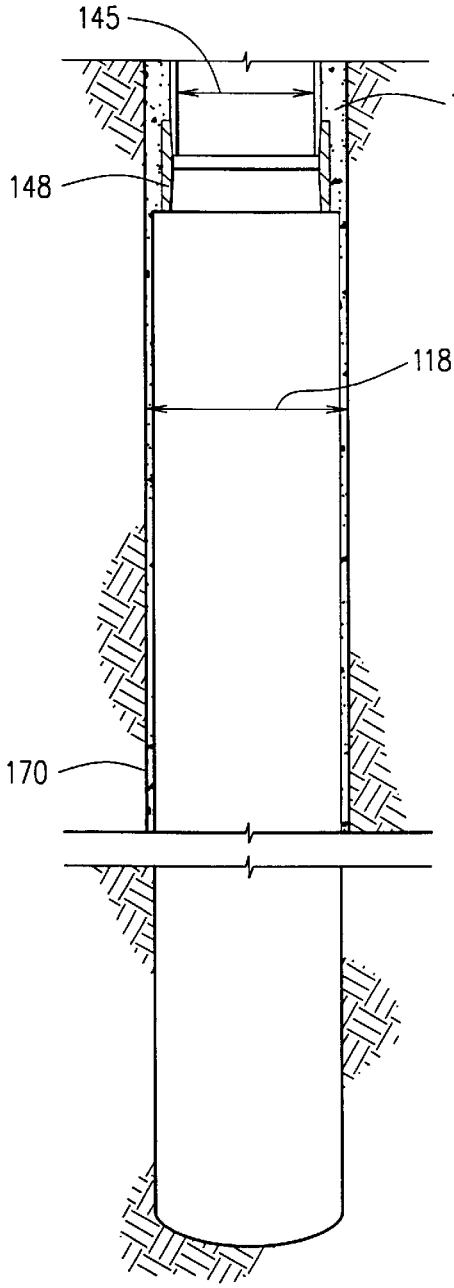
FIGS. 3C and 3D show the wellbore after it has been drilled to a desired depth and a running pipe has been lowered therein respectively.
Figure 3D:
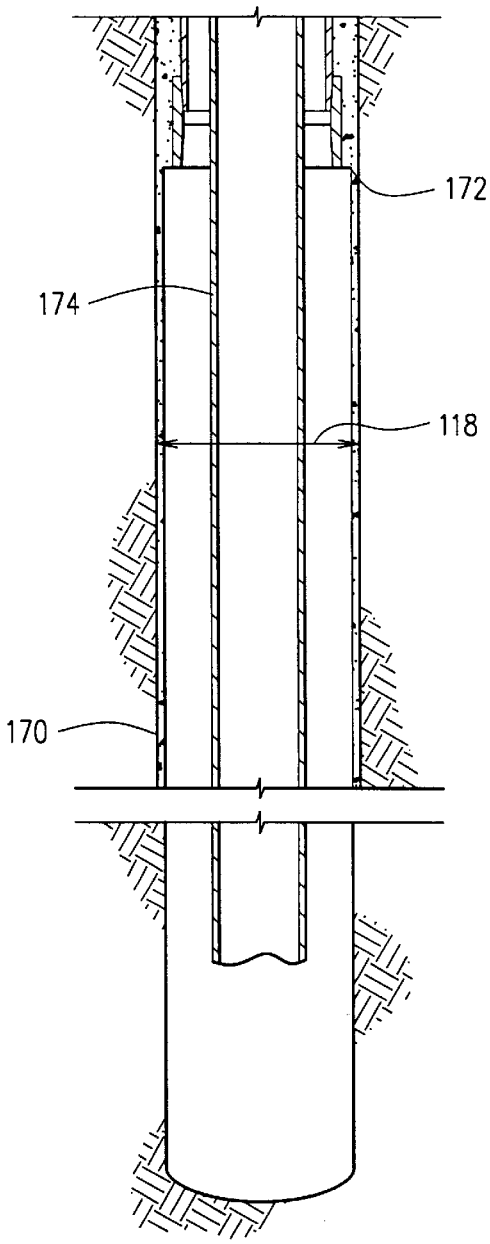
Figure 4:
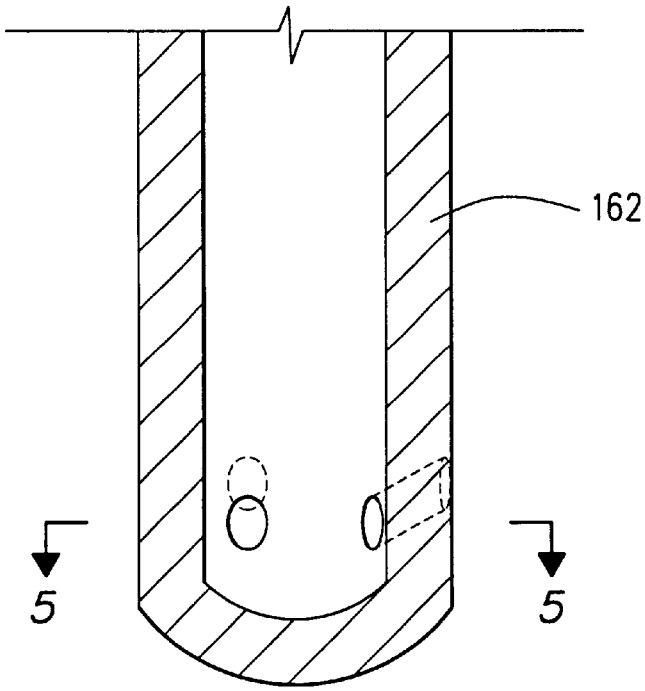
FIG. 4 shows the lower end of the diverter tool of FIGS. 3A and 3B.
Figure 5:
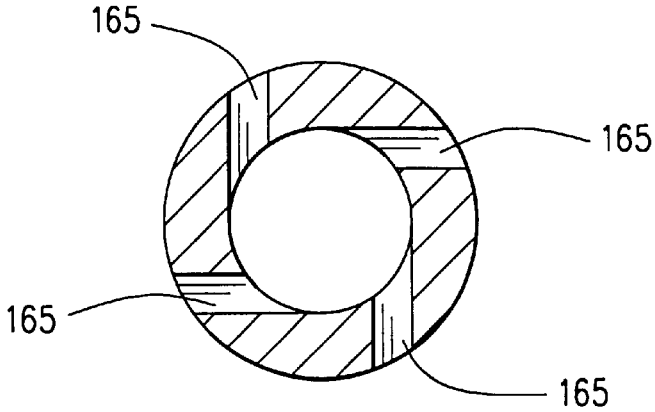
FIG. 5 is a section view taken from lines 5—5 of FIG. 4.

As depicted in FIGS. 3C and 3D, lower wellbore 170 has an upper end 172, which is above plugs 166 and 168 and float valve 154. Wellbore extension 170 has a diameter 118 which is greater than inner diameter 145 of casing 144. As with the previously described embodiment, only one trip is required to drill lower wellbore 170 since all of the materials utilized for the casing and other components below coupling 148 are comprised of a drillable material. Once lower wellbore 170 is complete, bit 112 can be removed through the portion of casing 144 above wellbore 170, and a running pipe, or liner 174 can be lowered therein.

Thus, the present invention provides a method and apparatus for drilling a wellbore or wellbore extension below a previously existing steel casing cemented in the well, wherein the wellbore extension has a diameter greater than the inner diameter of the casing. The invention provides a method and apparatus for doing so with one trip into the wellbore and thus it saves time and money. The present invention is therefore well adapted to carry out the objects and obtain the benefits and advantages mentioned as well as those which are inherent therein. While numerous changes to the apparatus and methods can be made by those skilled in the art, such changes are encompassed within the spirit of this invention as defined by the appended claims.

What is claimed is:

1. A floating apparatus for use with a well casing string comprising:

an outer case comprised of a drillable material;

a drillable check valve disposed in said outer case;

a drillable body portion connecting said check valve to said outer case; and a tubular extension comprised of a drillable material connected to and extending upwardly from said floating apparatus, said drillable tubular extension adapted to be connected to said casing string.

2. The floating apparatus of claim 1, wherein said drillable outer case is comprised of a composite material.

3. The floating apparatus of claim 2, wherein said composite material comprises fiberglass with resin.

4. The floating apparatus of claim 1, wherein said floating apparatus comprises a float shoe.

5. The floating apparatus of claim 1, wherein said floating apparatus comprises a float collar.

6. The floating apparatus of claim 1, wherein said body portion comprises cement.

7. The apparatus of claim 6, wherein said valve comprises:

a valve housing, said valve housing being connected to said outer case; and a valve element disposed in said valve housing, said valve element being moveable between a closed position wherein flow through said apparatus is prevented and an open position wherein flow therethrough is permitted.

8. The floating apparatus of claim 6, further comprising:

a drillable tubular extension connected to a lower end of said drillable outer case; and a second floating apparatus connected to a lower end of said drillable tubular extension connected to the lower end of the drillable outer case, said second floating apparatus comprising:

a drillable outer case; and a valve disposed in said outer case and connected thereto with a cement body portion.

9. An apparatus for use on a casing string comprising:

a drillable outer case having an upper end and a lower end;

a check valve disposed in said drillable outer case to allow flow downwardly through said apparatus and to prevent flow upwardly therethrough; and a drillable tubular extension connected to and extending upwardly from said upper end of said drillable outer case, said tubular extension having an upper end adapted to be connected to said casing string.

10. The apparatus of claim 9, wherein said drillable outer case is comprised of a composite material.

11. The apparatus of claim 10, said valve housing being connected to said outer case with a cement body portion.

12. A method of creating a wellbore extension below a casing cemented in a wellbore, the casing having float equipment connected thereto, the method comprising:

lowering a drill bit into said casing, said drill bit having a working diameter greater than said inner diameter of said casing cemented in said wellbore and having a non-working diameter less than said inner diameter of said cemented casing;

rotating said drill bit at a selected speed so that said drill bit expands radially from its non-working to its working diameter before said drill bit reaches said float equipment; and lowering said drill bit while said drill bit is at its rotating working diameter to drill out said float equipment and to create said wellbore extension, said wellbore extension having a diameter greater than said inner diameter of said casing cemented in said wellbore.

13. The method of claim 12, said float equipment comprising a float collar.

14. The method of claim 12, wherein said float equipment is connected to said casing with a drillable tubular, and wherein said method comprises performing said rotating step in said drillable tubular.

15. The method of claim 12 further comprising lowering said drill bit to a desired depth beyond said float equipment while said drill bit is at its rotating working diameter.

16. A method of drilling a wellbore below a cemented casing, said casing having float equipment connected thereto with a drillable tubular, the method comprising:

lowering a bi-center drill bit through said casing into said drillable tubular;

rotating said bi-center drill bit in said tubular so that it expands radially in said tubular to a diameter greater than an inner diameter of said cemented casing; and drilling out at least a portion of said tubular and drilling out said float equipment with said bi-center drill bit so that the wellbore below said casing has a diameter greater than said inner diameter of said casing.

17. The method of claim 16 further comprising:

drilling said wellbore having a greater diameter than said inner diameter of said casing to a desired depth below said casing.

18. The method of claim 16, wherein said float equipment comprises:

a drillable outer case;

a drillable valve disposed in said outer case; and a cement body portion connecting said valve to said outer case.

19. The method of claim 16, wherein said float equipment comprises a float collar.

* * * * *